United States Patent [19]

Michewich et al.

[11] 4,335,199

[45] Jun. 15, 1982

[54] HIGH CONTRAST BY IMAGEWISE IODIDE INFECTION IN A MIXED SILVER HALIDE SYSTEM

[75] Inventors: Daniel J. Mickewich, Arden, Del.; John R. Shock, Plainsboro, N.J.; Daniel F. Juers, Fairport, N.Y.

[73] Assignee: E. I. Du Pont de Nemours and Company, Wilmington, Del.

[21] Appl. No.: 122,502

[22] Filed: Feb. 19, 1980

[51] Int. Cl.[3] ..... G03C 1/84; G03C 5/24

[52] U.S. Cl. ..... 430/434; 430/949; 430/564; 430/599; 430/567

[58] Field of Search ..... 430/564, 599, 502, 603, 430/604, 605, 949, 571, 434, 569, 600

[56] References Cited

U.S. PATENT DOCUMENTS

| | | | |
|---|---|---|---|
| 2,592,250 | 4/1952 | Davey et al. | 430/569 |
| 2,996,382 | 8/1961 | Luckey et al. | 430/502 |
| 3,178,282 | 4/1965 | Luckey et al. | 430/502 |
| 3,206,313 | 9/1965 | Porter et al. | 430/564 |
| 3,598,597 | 8/1971 | Farren et al. | 430/605 |
| 3,695,881 | 10/1972 | Luckey | 430/502 |
| 3,761,276 | 9/1973 | Evans | 430/406 |
| 4,035,185 | 7/1977 | Evans et al | 430/567 |

*Primary Examiner*—Won Louie

[57] ABSTRACT

High contrast photographic images suitable for lithographic use are obtained with stable (nonlithographic) developers when iodide is released from a surface-sensitized iodobromide emulsion to induce development of the exposed areas in an internally sensitized core-shell emulsion. A bromoiodide or trihalide core is produced by balanced double jet precipitation, then the core is chemically sensitized and covered with a chlorobromide or chloride shell by balanced double jet precipitation or preferably by a cyclic pAg addition technique. The core-shell emulsion must have a sensitivity equal to or greater than the surface sensitized emulsion.

13 Claims, No Drawings

HIGH CONTRAST BY IMAGEWISE IODIDE INFECTION IN A MIXED SILVER HALIDE SYSTEM

BACKGROUND OF THE INVENTION

1. Field of the Invention

This invention relates to the field of photographic silver halide imagery, particularly as it relates to obtaining high contrast images for graphic arts applications.

2. Discussion of the Prior Art

In industrial printing applications such as lithography, high contrast dot images are required. Development of high contrast silver halide emulsions is believed to proceed catalytically, by a process known as "infectious development" of exposed silver halide emulsions by "infectious developers". These are notably unstable: they oxidize in air, the components react spontaneously when mixed, and they require frequent replenishment in order to insure reproducible results. There are noninfectious developers, usually referred to as continuous tone developers, which contain sufficient stabilizer to avoid the air oxidation problem, but they do not achieve the high contrast imagery attained by infectious development.

Luckey et al, U.S. Pat. No. 2,996,382, "Photographic Elements Having Improved Sensitivity" (1961), U.S. Pat. No. 3,178,282, "Photographic Elements Containing Surface Image And Fogged Internal Image Silver Halide Grains" (1965), and U.S. Pat. No. 3,695,881, "Positive Image Production With Unfogged Internal Image Silver Halide Emulsion Containing Mercaptan Retarder And A Surface Latent Image Silver Halide Emulsion" (1972); Farren et al, U.S. Pat. No. 3,598,597, "Speed And Contrast Of A Silver Halide Photographic Emulsion Obtained By Addition Of Silver Chloride Emulsion To Silver Bromide Emulsion" (1971); and Porter et al, U.S. Pat. No. 3,206,313, "Chemically Sensitized Emulsions Having Low Surface Sensitivity And High Internal Sensitivity" (1965) disclose means for obtaining increased contrast when using noninfectious developers, e.g., the use of fogged grains, variations in internal and exterior sensitization, and the use of mixed emulsions. However, the higher contrast so obtained is something less than what is needed for lithographic purposes. If good dot quality could be obtained by the use of stable continuous tone developers, major conveniences would result, such as better development latitude, reduced replenishment, less critical processor control, faster access time, higher speeds, and lower coating weights.

The goal of achieving the high contrast imagery characteristic of infectious development, minus the accompanying disadvantages of an unstable developer, has been long sought and has spurred inventive effort for appropriate emulsions, developers, machines, and mixing and monitoring devices. The principal objective of the present invention is to provide a photographic film of such a composition that infectious development can be induced between two types of silver halide grains within the film, while at the same time employing a stable continuous tone developer. Thereby the disadvantages of previous systems would be overcome.

SUMMARY OF THE INVENTION

This invention provides a photographic element which comprises a support, and a mixture of two silver halide emulsions on said support: (1) an internally sensitized silver halide emulsion comprising a core covered by a shell (a so-called core-shell emulsion in which the core is chemically sensitized); having a sensitivity equal to or greater than (2); and (2) a surface-sensitized iodobromide or trihalide silver halide emulsion capable of releasing iodide ions when developed in a stable developer, which iodide ions function to produce infectious development of exposed grains of emulsion (1). With this photographic element it is possible to produce high contrast and high quality images which are suitable for lithography and are characteristic of those obtained by using infectious developers, even though the exposed film is developed in a continuous tone developer.

DETAILED DESCRIPTION OF THE INVENTION

The theory of the invention is that the surface-sensitized grains act as trigger grains which release iodide ions in the process of development; these uncover the latent images beneath the outer shell of the exposed internally sensitized core-shell grains, allowing the chemically sensitized core to react with the developer. Until this occurs the outer shell shields the sensitivity centers created on the core from contact with the developer solution. Hence, in those areas where the grains have not been exposed so as to produce a latent image, an iodide reaction on the shell does not result in development since these grains behave just as would other sensitized grains which are not exposed. Thus, even though the spread of iodide ions is indiscriminate within the emulsion layer, the grains become developable only where they have been exposed sufficiently to produce a latent image.

Since the process for providing the desired high quality image is initiated or triggered by the surface-sensitized portion of the emulsion the latter must not only contain iodide in the grain structure but also must be highly responsive to the developer so as to insure a rapid release of iodide ions. If the sensitivity of the internally sensitized core-shell grains is lower than that of the trigger grains the latter will not promote a high contrast reaction, since the silver density buildup provided by the core-shell grains will lag behind that resulting from the trigger grains. On the other hand, if the sensitivity of the internally sensitized core-shell grains is equal to or greater than that of the trigger grains the rapid reaction required for high contrast will be promoted. In addition, if the core-shell grains also contain iodide there will be a high concentration of additional iodide ions released in areas where the emulsion has been exposed. These will serve to further promote reactivity. No such release of iodide ions will occur in nonexposed areas since the grains in those areas are not in the form of a latent image, which is required for development.

To function properly, the invention requires that two distinct types of silver halide grains be specially formulated. These grains can then be simply mixed together and coated on a support, or they may be coated in adjacent or separated layers as long as the iodide ions can diffuse from the trigger grains to the image-promulgating core-shell grains. Techniques well-known in the photographic art may be used to achieve the balance of characteristics required for the two emulsions, including: grain size, iodide content, degree of chemical sensitization, and the inclusion of speed adjuvants such as polyethylene oxide, metal ion dopants, etc. It has been found to be particularly useful to include a development accelerator in the emulsion such as 4-hydroxypyrazolo [3,4-d] pyrimidine as in PD-1643, Ser. No. 112,296 filed Feb. 6, 1980, the disclosure of which is hereby incorporated by reference. It is believed that the less soluble shell of chloride ion which protects the sensitized core is brought about by the displacement of the chloride ion by the much more insoluble iodide ion. Contrasts of 15–20 can be obtained when a 4% IBr trigger crystal causes the infection of an internally sensitized core-shell crystal with a 4% IBr core and a 20/80 Br/Cl shell. Iodide ion added to the developer has given best results with approximately a 1:1 ratio of the two types of crystals. Trigger crystals of 0.02 cubic microns containing 2% iodide gave a poor but still noticeable infectious effect.

In addition to core-shell emulsions known in the art, it is also possible to use the novel grains of assignee's application Ser. No. 972,972, "Novel Silver Halide Crystals with Two Surface Types" filed Dec. 26, 1978 and by further precipitation grow a shell to cover the sensitized core grain.

The production of grains with high contrast is also promoted by incorporation of metals such as rhodium, iridium, and thallium as dopants in the surface-sensitized trigger grains, whereby the threshold of development is restrained. Rhodium salts added in amounts from 0.127 to 6.99 parts per million for the trigger grains provide an effective means of increasing toe gradient, as is well-known in the art. Rhodium addition did not, however, show any particularly useful effect with the internally sensitized core-shell grains. This would be expected since initially only the trigger grains participate in the image formation. As a result, whatever toe shape is inherent in these will be characteristic for the curve since it is only after iodide is released by development of the trigger grains that the core is uncovered. Thereupon, the internally sensitized grains participate in the rapid development which produces the high gradient and density. Finer grain sizes and high chloride content emulsion also provide a high contrast emulsion.

The supports useful in our photographic elements comprise conventional supports, such as paper, cellulose ester film, polyvinyl resin film, polystyrene film, polyester film, etc., as well as nonflexible supports, such as glass.

Photographic films which can be processed in automatic machines as well as in tray or deep tank systems used in the graphic arts and printing industry have the silver halide grains suspended in a colloid binder system in which the primary component is usually gelatin. Other binder adjuvants such as a latex, covering power polymers, gelatin polymers, synthetic proteins, and polyvinyl alcohol may be present in such photographic films for various functions. However, it is the gelatin which facilitates the development process. It does this by (1) swelling sufficiently to allow the developer solution to obtain access to the silver halide grains, while (2) maintaining integrity of the structure through the fixing and washing steps, until (3) the gelatin finally contracts upon drying to stabilize the silver image.

To enhance the production of high contrast and high quality images in accordance with the present invention it was found advantageous to use a higher developer temperature than normal, coupled with an increase in the gelatin content of the emulsion layer of the film. While increasing the gelatin content is known to be a factor in slowing down development, this is compensated for by the higher development rate at the higher temperature. Since the present invention uses a stable developer the higher temperature does not create the problem that would exist with an infectious developer, which would be less stable with higher temperature.

These and other details of the present invention are illustrated by the following examples.

EXAMPLE 1

Balanced double jet precipitation was used, while maintaining a steady pAg of about 6.5, to produce monodisperse silver iodobromide crystals containing 4% iodide and having a mean grain volume of 0.027 cubic microns. A portion of the monodisperse grains so prepared was chemically sensitized with gold and sulfur and used for the trigger grains. Another portion of the monodisperse grains served as a core for growing core-shell grains via a balanced double jet precipitation of silver chlorobromide on the surface. The grains were then chemically sensitized with gold and sulfur until a sensitivity was obtained which was greater than that of the trigger crystals. After completion of the sensitization a second shell was grown over the sensitized core-shell grain, consisting of 20% silver halide bromide and 80% silver halide chloride, again using the balanced double jet precipitation technique. Coatings were made of combinations of the trigger grains and the internally sensitized core-shell grains in a 50—50 unit mixture. As controls, comparative coatings were made of the separate grain types, and of a commercial lithographic emulsion. In addition to normal after-additions these emulsions all contained 4-hydroxypyrazolo [3,4-d] pyrimidine as a development accelerator, in the amount of 0.17 g/mol silver halide.

A developer solution for testing the effects of the present invention was prepared as follows:

Stock Solution

Add, in order, to 1750 ml distilled water

| | |
|---|---|
| $K_2SO_3$ | 200 g |
| $K_2CO_3$ | 80 g |
| Hydroquinone | 100 g |
| KBr | 8 g |
| Dilute to | 1900 ml |

Antifoggant Solution 0.5 g 5-nitroindazole per 100 ml ethyl alcohol.

Working Solution

Dilute 512 ml of stock solution to 1000 ml;
Adjust pH to 10.3 with KOH pellets;
Add 10 ml antifoggant solution;
Add 100 g $Na_2SO_4$.

Film strips prepared from the combination of grains, and film strips prepared from the separate grains, were exposed and processed in the above developer. Commercial litho film, i.e., film strips coated with a commercial lithographic gelatino-silver halide emulsion, were similarly exposed and processed in a commercial infectious lithographic developer which was not stabilized. Examination of the resulting processed strips revealed that: the trigger grains alone gave typical medium contrast; the internally sensitized core-shell grains alone showed no development response at all, giving completely clear strips; and the 50—50 combination of trigger and internally sensitized core-shell grains gave the same high contrast and density as was achieved with the commercial litho film.

EXAMPLE 2

Emulsions were prepared as in Example 1 except that after a portion had received chemical sensitization to obtain an internal speed greater than that of the trigger grains, a cyclic pAg addition technique was used to form the shell. Unlike the balanced double jet precipitation method used in Example 1, in which a steady pAg of about 6.5 is maintained, the cyclic technique involves adding silver nitrate until the pAg reaches 4, and then switching to the addition of the halide solution until the pAg reaches 8. Within these limits the silver and halide solutions are alternatively added until the total reaches the amount desired to form the shell.

It was found that this technique not only gave the same desirable results as in Example 1, but provided the additional advantage of giving lower fog levels and a higher resistance to dichroic fog. This is believed to be due to better coverage of the sensitivity centers.

EXAMPLE 3

The addition of ammonia with ammonium halide salts was found to be effective for growing larger grain sizes. This is illustrated by the following precipitation procedure:

Reagents

Solution A: 3 N $AgNO_3$
Solution B:
11 Liters 3 M $NH_4Br$
220 g KI
20 ml of solution of 0.024 g/l
$Na_3RhCl_6.12\ H_2O$
Stirred Solution in precipitation vessel:
20 Liters Distilled Water
600 g Photographic grade limed bone gelatin
2400 g $NH_4NO_3$
Precipitation Sequence:

1. Allow 15 minutes after mixing of Solution B for equilibration before starting.
2. Add 20 ml of 12 N ammonium hydroxide.
3. Wait 2 minutes, then add 35 ml 1 M KBr.
4. With pAg set point at 6.5 start precipitation with flow rate of 25 ml/min.
5. After 15 minutes change flow to 200 ml/min. gradually over 6 minute period.
6. Continue for 42 minutes.
7. Acidify to pH 2.0 with 3 N sulfuric acid, cool to 29.5° C., and coagulate with polyvinyl alcohol o-sulfobenzaldehyde acetal.
8. Decant and wash emulsion.

Using the above procedure and varying the amount of iodide, ammonia, and rhodium (including using no rhodium at all for the internally sensitized core-shell grains) useful grains were produced with sizes from 0.014 to 0.074 cubic microns with $\alpha$ values of 0.18 to 0.34. Particularly useful trigger grains contained 3 to 4% iodide and had a grain size of about 0.02 cubic microns.

EXAMPLE 4

Mixtures of trigger grains and internally sensitized core-shell grains were prepared as in Example 2, except that two different levels of gelatin binder were used, 43 g and 67 g per mole of silver halide. When film samples of these were processed in the developer of Example 1 at a temperature of 35° C. it was found that the low gelatin content film did not produce good lithographic dot quality due to ragged edges, while the higher gelatin content film gave clean edged dots which were equivalent to the control dots produced from a commercial film processed in a commercial infectious lithographic developer.

EXAMPLE 5

Very small crystals of 0.002 cubic microns and 4% iodide content were prepared and tested as trigger grains in comparison with 0.02 cubic micron grains containing from 2 to 6% iodide. It was expected that the faster development rate of the smaller crystals would be an advantage, but results showed that in fact much poorer infection occurred. These results suggest that the dynamics of the release of iodide are very important to the present invention.

EXAMPLE 6

When Example 1 was repeated, except that 0.036 g KI was added to the working developer of Example 1, results equivalent to Example 1 were obtained.

EXAMPLE 7

Grains were prepared as in Example 1 except that the first step of forming the shell over the iodobromide grain was eliminated and chemical sensitization took place on this iodobromide core which was then covered with a chlorobromide shell. While it was possible to obtain high contrast development with these internally sensitized core-shell grains in combination with trigger grains when processed as in Example 1, the control of sensitization was not as satisfactory as when chemical sensitization took place after a chlorobromide shell was grown around the iodobromide core prior to the final growth of the outer shell.

We claim:

1. A photographic element comprising a support, and a mixture of two non-fogged silver halide emulsions on said support:

(1) an internally sensitized core-shell emulsion having an internal sensitivity equal to or greater than that of emulsion (2);

(2) a surface-sensitized silver iodobromide or trihalide emulsion capable of releasing iodide ions upon being developed in a stable developer, which iodide ions serve to produce infectious development of exposed grains of emulsion (1).

2. The photographic element of claim 1 wherein emulsion (1) contains an iodobromide core.

3. The photographic element of claim 2 wherein emulsion (1) contains a chlorobromide shell.

4. The photographic element of claim 3 wherein the chloride content of the shell is greater than 50%.

5. The photographic element of claim 4 wherein the chlorobromide shell of the core-shell emulsion (1) is about 80 mole % Cl/20 mole % Br.

6. The photographic element of claim 1 wherein emulsions (1) and (2) are mixed in about a 1:1 ratio.

7. The photographic element of claim 1 wherein emulsion (2) contains rhodium to control the gradient.

8. The photographic element of claim 1 wherein emulsions (1) and (2) contain 4-hydroxy [3,4-d] pyrimidine in amount sufficient to act as a development accelerator.

9. A process wherein a photographic silver halide emulsion film coated upon a support is exposed, and the resulting latent image is translated into a visible silver image by action of a continuous tone developer, characterized in that the silver halide emulsion is composed of a mixture of two non-fogged silver halide emulsions (1) and (2), emulsion (1) being an internally sensitized core-shell emulsion having an internal sensitivity equal to or greater than that of emulsion (2); emulsion (2) being a surface-sensitized silver iodobromide or trihalide emulsion capable of releasing iodide ions upon being developed in a stable developer, and wherein during the development process iodide is released from the surface-sensitized iodobromide or trihalide emulsion to induce development of the exposed areas in the internally sensitized core-shell emulsion, whereby a high contrast photographic image suitable for lithographic use is obtained.

10. The process of claim 9 wherein emulsions (1) and (2) are mixed together in approximately a 1:1 ratio prior to being coated on the support.

11. The process of claim 9 wherein internally sensitized core-shell emulsion (1) is produced by first forming a silver iodobromide or trihalide core by a balanced double jet precipitation, chemically sensitizing said core, and then covering the sensitized core with a silver chlorobromide or silver chloride shell.

12. The process of claim 11 wherein said silver chlorobromide or silver chloride shell is produced by balanced double jet precipitation or by a cyclic pAg addition technique.

13. The process of claim 11 wherein the sensitivity of said core-shell emulsion (1) is determined before the shell is precipitated on the core.

* * * * *